United States Patent [19]

Willa et al.

[11] 4,389,026

[45] Jun. 21, 1983

[54] DISPENSING CONTAINER FOR ROLLED PRODUCTS

[76] Inventors: Siegfried Willa, Haus Panorama; Max Zenhäusern, Kehrstrasse 48, both of 3904 Naters, Canton of Valais, Switzerland

[21] Appl. No.: 232,534

[22] Filed: Feb. 9, 1981

[30] Foreign Application Priority Data

Feb. 7, 1980 [CH] Switzerland ..... 993/80

[51] Int. Cl.[3] ..... B65H 19/04

[52] U.S. Cl. ..... 242/55.3; 242/55.53

[58] Field of Search ..... 242/55.2, 55.3, 55.53, 242/55.54; 225/34, 46, 47, 67; 312/38, 39

[56] References Cited

U.S. PATENT DOCUMENTS

| | | | |
|---|---|---|---|
| 2,839,346 | 6/1958 | Lawalin | 312/39 |
| 3,266,742 | 8/1966 | Pena | 242/55.3 |
| 3,580,651 | 5/1971 | Gauper | 312/39 |
| 3,630,519 | 9/1971 | Brown et al. | 242/55.3 |

FOREIGN PATENT DOCUMENTS

| | | | |
|---|---|---|---|
| 851104 | 5/1977 | Belgium . | |
| 2630897 | 9/1977 | Fed. Rep. of Germany . | |
| 3018571 | 11/1980 | Fed. Rep. of Germany | 242/55.3 |
| 496433 | 11/1970 | Switzerland . | |

*Primary Examiner*—Leonard D. Christian
*Attorney, Agent, or Firm*—Oblon, Fisher, Spivak, McClelland & Maier

[57] ABSTRACT

A roll of material, e.g., toilet tissue, rests ready for use upon the middle portion of a swivel support. The roll can be manually placed in optimum position through lateral apertures. When the roll is empty, a front flap of the swivel support, extending out beyond the front wall of the container, is pressed down, so that the swivel support swings upward and thereby ejects the empty roll through an opening in the container. As the front flap is pressed farther down, a locking lever, which previously prevented a spare roll from dropping, is pushed into a vertical position by a rear flap of the swivel support. When the front flap is released, the replacement roll slides onto the swivel support and presses the lower arm of the locking lever against the front wall of the container so that the upper arm of the lever regains its normal oblique position and prevents the next spare roll from dropping. Half-used rolls cannot be removed from the container, nor can a replacement roll drop into place until the empty roll has been ejected, thus ensuring trouble-free unrolling of the material.

6 Claims, 3 Drawing Figures

DISPENSING CONTAINER FOR ROLLED PRODUCTS

This invention relates to dispensing apparatus for rolled products, particularly for rolls of toilet tissue, of the type having a container including a dispensing opening through which the rolled material can be withdrawn and empty rolls removed. A container for rolls of paper, particularly rolls of toilet tissue or other household products, is disclosed, for example, in Swiss Pat. No. 496,433. One roll is held in a position in which the paper can be withdrawn for use, while the remaining rolls are held above in reserve. The roll in use is guided by a hinged tongue which prevents a spare roll from dropping down but can be pivoted in such a way that the spare roll drops into the position of use while allowing an empty roll to be removed.

One drawback of this prior art container is that not just an empty roll but also a half-used roll of paper can be removed. This is undesirable when the container is installed in a public toilet or in a rest room and provided with a lock so that the paper cannot be stolen. Moreover, the half-used or empty roll is not automatically ejected by the tongue but must be removed by hand. If this is not done, it may happen that when the tongue is pivoted, a spare roll drops onto the partially used or empty roll and hence cannot be properly unrolled.

It is an object of this invention to provide an improved dispensing container for rolled products which does not exhibit the aforementioned drawbacks.

It is a further object of this invention to provide a dispensing container in which a spare roll is prevented from reaching the position of use before the empty roll has been removed from the container.

Another object of this invention is to provide such a dispensing container in which both the automatic ejection of the empty roll and the positioning of the new roll for use are accomplished by means of a single manipulation.

It is likewise an object of this invention to provide a dispensing container in which the rolls can be placed in either unrolling direction so that the paper can easily be torn off regardless of which way the rolls are placed.

Still another object of this invention is to provide such a dispensing container in which the roll in use can be adjusted for optimum withdrawal of the paper.

To this end, in the dispensing container according to the present invention, of the type initally mentioned, the improvement comprises a swivel support pivoted about a lower pivot bar disposed below the dispensing opening for guiding a roll in use, and a locking lever pivoted about an upper pivot bar disposed above the dispensing opening for blocking one or more spare rolls.

Other objects and advantages of the invention will become apparent from the following detailed description of a preferred embodiment thereof, taken in conjunction with the accompanying drawings, in which.

Figure 1:
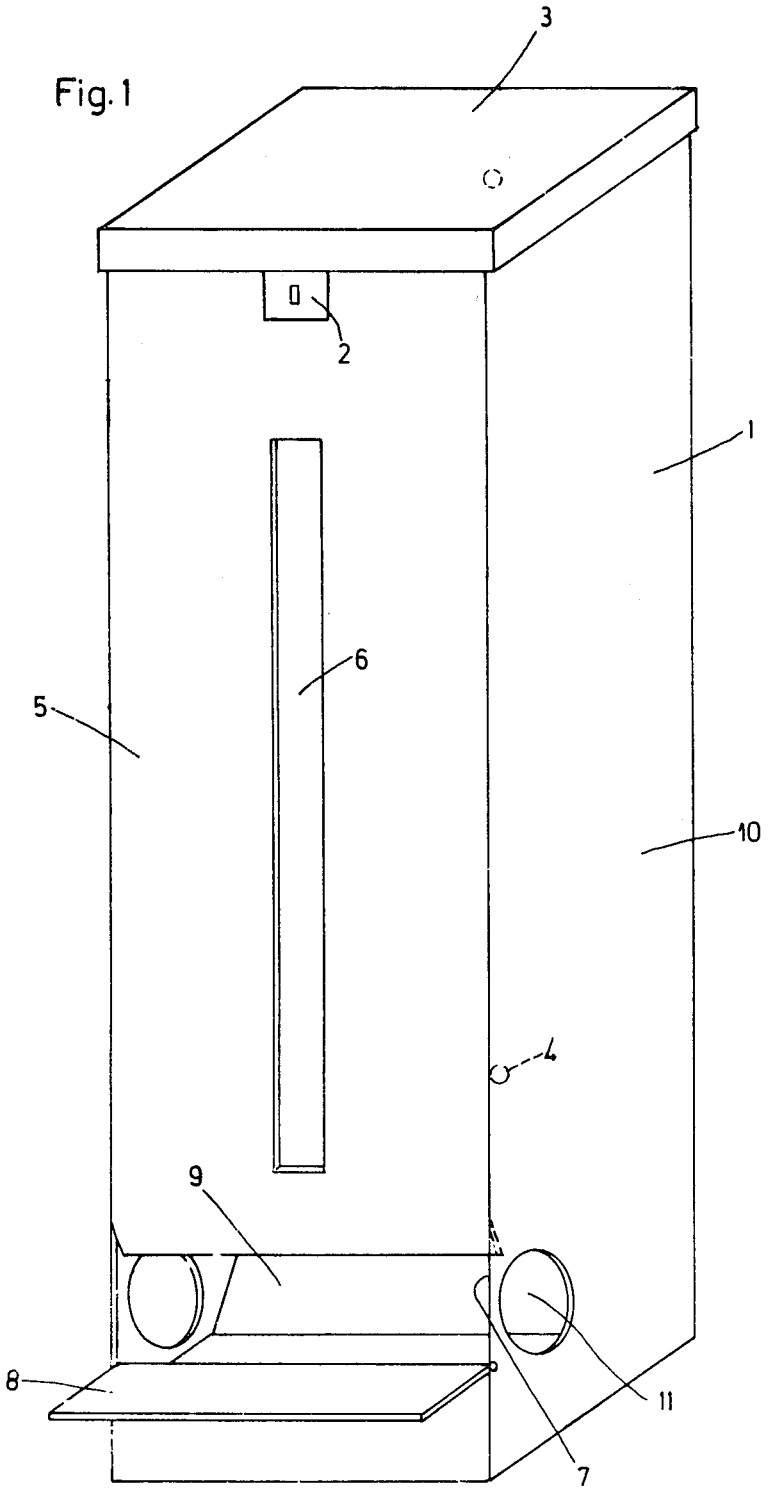
FIG. 1 is a perspective view of the dispensing container for rolls of paper.

The roll container shown in a perspective view in FIG. 1, intended particularly for rolls of toilet tissue, comprises a housing 1 having a lid 3 which can be locked by means of a lock 2. On the back of housing 1 are two holes 4, shown in broken lines, for securing the container to a wall in the room where the rolls of paper are to be used. In the front wall 5 of housing 1 is a vertical slot 6 for ascertaining whether there are still spare rolls in the container. Front wall 5 further includes near the bottom thereof a horizontal dispensing opening 7, through which empty rolls are also removed. A front flap 8 of a swivel support 9 extends out beyond front wall 5 at the bottom of opening 7. Sidewalls 10 of housing 1 include circular apertures 11 disposed at approximately the same level as opening 7.

Figure 2:
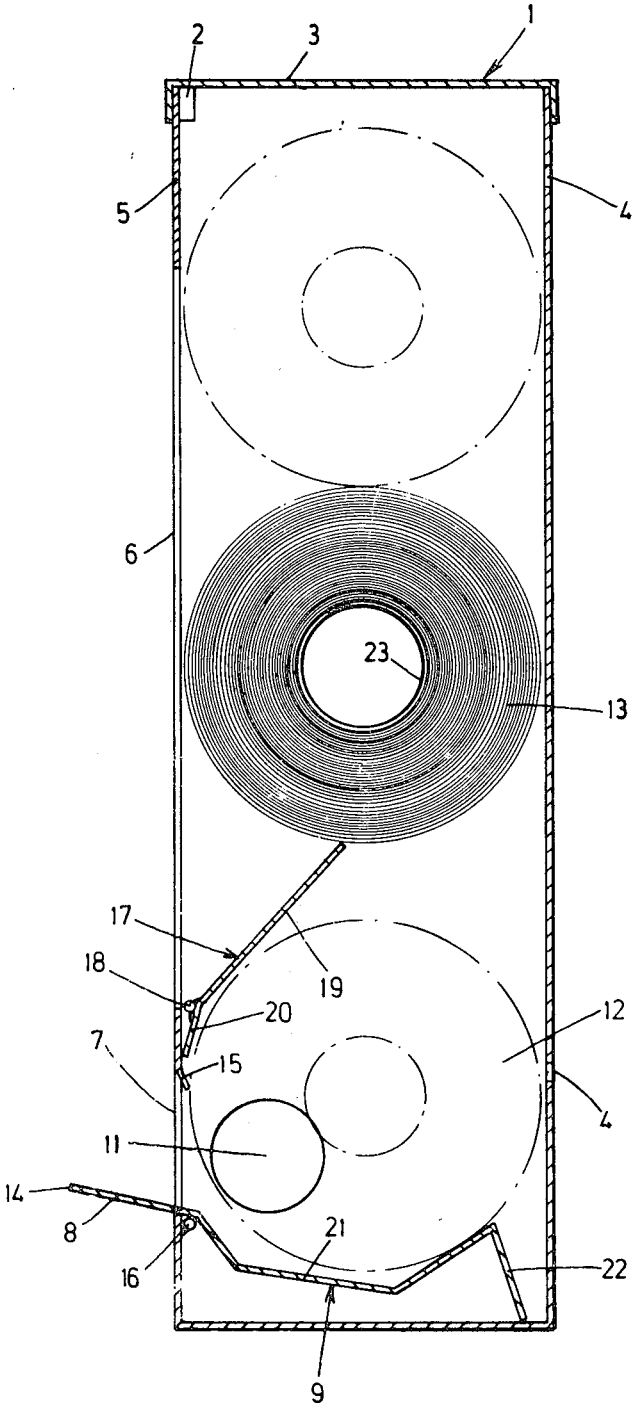
FIG. 2 is a longitudinal section through the container in use.

In FIG. 2, the container is shown as holding a roll 12 of paper to be dispensed and two spare rolls 13. Roll 12, in the position ready for use, rests upon swivel support 9 and can be adjusted by hand through apertures 11 so that the paper to be dispensed unrolls easily. Moreover, it does not matter which way roll 12 has been placed in the container, i.e., in which direction it unrolls, since the length of paper may be torn off either against the front edge 14 of flap 8 or against the edge 15, bent inwardly at an angle, of front wall 5. Edges 14 and 15 may be serrated for this purpose.

Swivel support 9 is pivotable about a bar 16 fixed to the inside of front wall 5 directly below opening 7. Disposed above bent-in edge 15 bounding opening 7 is a locking lever 17 pivotable about a bar 18 which is likewise fixed to the inside of front wall 5. When roll 12 is in the paper-withdrawal position shown in FIG. 2, the upper arm 19 of lever 17 lies against roll 12 and prevents spare roll 13 from dropping down. In this position, the lower arm 20 of lever 17 presses against front wall 5. Opening 7 is made so narrow that only completely empty rolls will pass through it.

Figure 3:
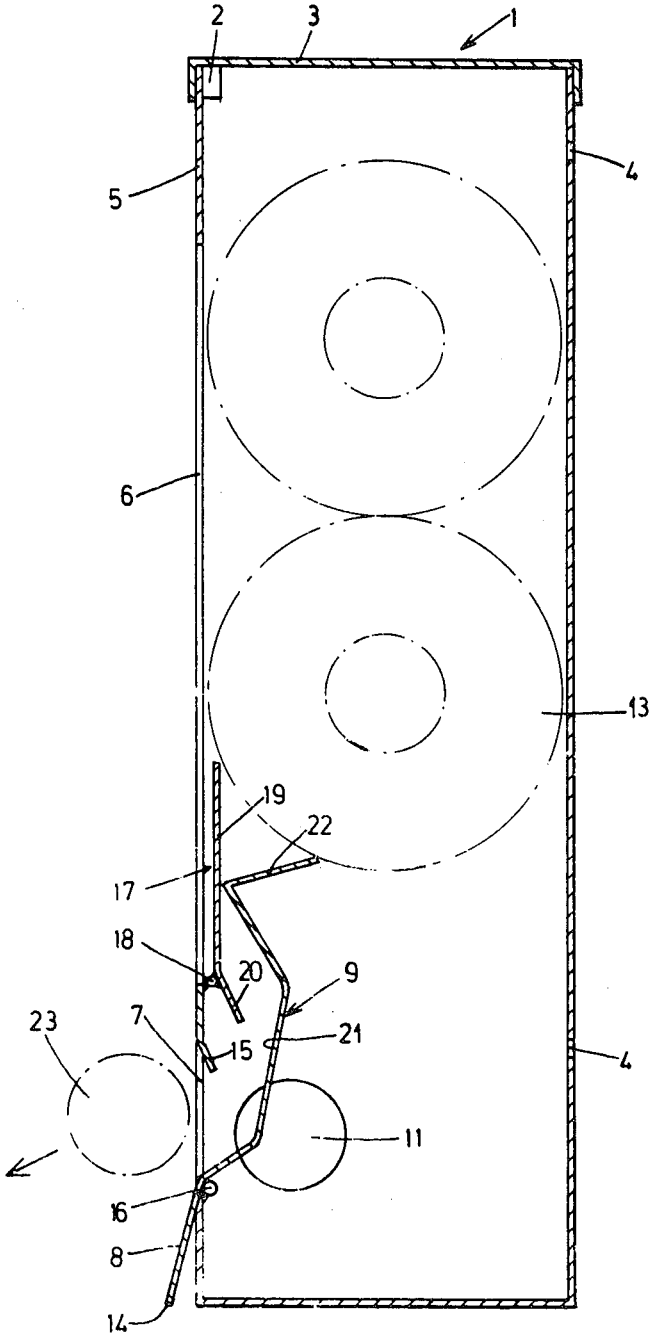
FIG. 3 is a longitudinal section through the container in the roll-changing position.

The replacement of rolls will now be explained with reference to FIG. 3. When roll 12 is empty and is to be replaced, front flap 8 of swivel support 9 is pressed down, causing empty roll core 23, lying upon the middle portion 21 of swivel support 9, to be ejected through opening 7. Experience has shown that core 23 will be most accurately ejected through opening 7 when edge 15 is bent inwardly at an angle of preferably about 30° to the vertical.

As front flap 8 is pressed farther downward, swivel support 9 tilts into an upright position, whereby rear flap 22 of support 9 pushes up arm 19 of lever 17. However, this can occur only if empty core 23 has actually been ejected from the container. Replacement roll 13 now comes to rest against rear flap 22 of swivel support 9. When front flap 8 is released, the weight of roll 13 pushes swivel support 9 from its upright position back into its horizontal position, whereby roll 13 drops into middle portion 21 of support 9. In falling, roll 13 presses the inwardly projecting arm 20 of lever 17 against front wall 5, so that upper arm 19 of locking lever 17 once more projects obliquely inward and keeps the next spare roll from dropping down.

A deodorant may be placed in housing 1, e.g., at the bottom thereof beneath swivel support 9. In this case, the lower portions of walls 5 and 10 of the container will preferably be provided with holes or slits.

What is claimed as new and desired to be secured by Letters Patent of the United States is:

1. A dispensing container for rolls of material, particularly for rolls of toilet tissue, of the type having sidewalls and a vertical front wall including a horizontal opening for withdrawal of said material and removal of empty said rolls, wherein said container includes:

a first horizontal pviot bar disposed adjacent to the lower edge of said opening;

a second horizontal pivot bar disposed adjacent to the upper edge of said opening, roll-support means pivotable about said first pivot bar from a first normal dispensing position to a second roll-ejection and replacement position, and lever means pivotable about said second pivot bar from a first normal roll-retaining position to a second substantially vertical roll-release position, wherein said roll support means contacts said lever means in said second position.

2. The container of claim 1, wherein said roll-support means includes a front flap projecting outwardly beyond said front wall for pivoting said roll-support means and a rear flap cooperating in said roll-ejection and -replacement position with said lever means.

3. The container of claim 1 or claim 2, wherein said lever means comprises an upper arm for retaining one of said rolls when said roll-support means is in said normal dispensing position and a lower arm resting against said front wall when said roll-support means is in said normal dispensing position.

4. The container of claim 1 or claim 2, further comprising a roll-adjustment aperture included in each of said sidewalls substantially at the level of said opening.

5. The container of claim 1 or claim 2, wherein said upper edge of said opening is bent into the interior of said container.

6. The container of claim 5, wherein said upper edge is bent at an angle of about 30° to said front wall.

* * * * *